US010380973B2

(12) United States Patent
Aydin et al.

(10) Patent No.: US 10,380,973 B2
(45) Date of Patent: Aug. 13, 2019

(54) LUMINANCE COMFORT PREDICTION AND ADJUSTMENT

(71) Applicant: Disney Enterprises, Inc., Burbank, CA (US)

(72) Inventors: Tunc Ozan Aydin, Zurich (CH); Samir Mahmalat, Zurich (CH)

(73) Assignee: Disney Enterprises, Inc., Burbank, CA (US)

( * ) Notice: Subject to any disclaimer, the term of this patent is extended or adjusted under 35 U.S.C. 154(b) by 150 days.

(21) Appl. No.: 15/422,210

(22) Filed: Feb. 1, 2017

(65) Prior Publication Data

US 2018/0218709 A1 Aug. 2, 2018

(51) Int. Cl.

| | |
|---|---|
| ***G09G 5/10*** | (2006.01) |
| ***G09G 5/00*** | (2006.01) |
| ***G09G 5/02*** | (2006.01) |

(52) U.S. Cl.

CPC ..... *G09G 5/10* (2013.01); *G09G 5/005* (2013.01); *G09G 5/02* (2013.01); *G09G 2320/0238* (2013.01); *G09G 2320/0271* (2013.01); *G09G 2320/0626* (2013.01); *G09G 2320/10* (2013.01); *G09G 2360/141* (2013.01); *G09G 2360/144* (2013.01); *G09G 2360/147* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 2006/0153301 | A1* | 7/2006 | Guleryuz | H04N 19/159 375/240.16 |
| 2010/0053381 | A1* | 3/2010 | Hasegawa | H04N 5/23229 348/241 |
| 2011/0175925 | A1* | 7/2011 | Kane | G01J 1/42 345/589 |
| 2013/0121419 | A1* | 5/2013 | Le Dinh | H04N 7/014 375/240.16 |
| 2017/0359488 | A1* | 12/2017 | Chen | H04N 1/6019 |

OTHER PUBLICATIONS

Irawan et al., "Perceptually Based Tone Mapping of High Dynamic Range Image Streams", EGSR '05, pp. 231-242 (2005).

Vangorp et al., "A Model of Local Adaptation," ACM Trans. Graph., 34(8):1-166:13 (2015).

* cited by examiner

*Primary Examiner* — Sarah Le

(74) *Attorney, Agent, or Firm* — Sheppard Mullin Richter & Hampton LLP

(57) ABSTRACT

One or more levels of maladaptation are calculated relative to frames of media content having abrupt jumps from periods of low illumination to bright illumination when visual acuity may be lost and/or discomfort may be experienced. These levels of maladaptation may be correlated with subjectively determined levels of perceived luminance discomfort. Based upon the levels of perceived luminance discomfort that can be derived from the levels of maladaptation, the media content may be adjusted.

20 Claims, 5 Drawing Sheets

LUMINANCE COMFORT PREDICTION AND ADJUSTMENT

TECHNICAL FIELD

The present disclosure relates generally to image processing.

DESCRIPTION OF THE RELATED ART

Interest in distributing video or other visual content having high dynamic range (HDR) is growing due to its ability to provide an enhanced viewing experience compared to conventional standard dynamic range (SDR) content. However, content that is filmed in HDR and/or presented on an HDR display may have downsides associated with the extended dynamic range. For example, a viewer's visual system may become strained during abrupt transitions from dark frames of content to much brighter frames of content. This can lead to viewing discomfort.

BRIEF SUMMARY OF THE DISCLOSURE

In accordance with one embodiment, a computer-implemented method, comprises analyzing media content and computing one or more adaptation states relative to the media content. The computer-implemented method further comprises correlating the one or more adaptation states to one or more corresponding levels of perceived luminance discomfort experienced by a viewer of the media content. Further still, the computer-implemented method comprises adjusting luminance of the media content to comport with one or more desired luminance-based effects. In one aspect, the analyzing of the media content comprises determining a luminance level associated with a pixel of a frame of the media content. In another aspect, the analyzing of the media content comprises determining a luminance level associated with a spatial neighborhood approximately about the pixel. In still another aspect, the analyzing of the media content comprises determining an ambient luminance level relative to the pixel.

The one or more adaptation states comprises determining a level of local adaptation predicted as being experienced by the viewer relative to the pixel. The level of local adaptation is determined relative to a period between at least two times during which the luminance level associated with the pixel is determined.

In some embodiments, the computer-implemented method further comprises applying a pooling function to combine the one or more corresponding levels of perceived luminance discomfort associated with determined luminance levels of one or more pixels of a frame of the media content, the combination of the one or more corresponding levels of perceived luminance discomfort comprising a frame-wide estimate of perceived luminance discomfort. Each of the one or more corresponding levels of perceived luminance discomfort comprises a subjective determination of discomfort experienced during exposure to test media content having commensurate luminance characteristics as the analyzed media content.

The computer-implemented method of claim may further comprise applying a transducer function to translate characterization of the one or more adaptation states to characterizations of perceived luminance discomfort. In some embodiments, the adjusting of the luminance of the media content to comport with one or more desired luminance-based effects comprises applying a mathematical optimization function adapted to maintain a mean luminance of the media content below a luminance threshold. In some embodiments, the adjusting of the luminance of the media content to comport with one or more desired luminance-based effect comprises applying a mathematical function adapted to increase luminance in one or more frames of the media content to coincide with a visual thematic element of the media content.

In accordance with another embodiment, a system comprises one or more processors, and a memory having computer code being executed to cause the one or more processors to: analyze one or more pixels of a frame of media content; compute one or more adaptation states relative to each of the one or more pixels; and translate the one or more adaptation states to one or more estimates of perceived luminance discomfort when the one or more adaptation states is indicative of maladaptation of a visual system viewing the media content.

In accordance with one embodiment, the computer code being executed further causes the one or more processors to determine a luminance level associated with a spatial neighborhood approximately about each of the one or more pixels. In accordance with another embodiment, the computer code being executed further causes the one or more processors to determine an ambient luminance level relative to each of the one or more pixels. The one or more computed adaptation states may be indicative of maladaptation on spatial and temporal levels.

In some embodiments, the code being executed to cause the one or more processors to translate the one or more adaptation states comprises computer code that when executed, causes the one or more processors to convert characterizations of the one or more adaptation states from physical luminance units to subjective rankings of the perceived luminance discomfort.

In some embodiments, the system may further comprise a post-processing system having computer code being executed to cause the post-processing system to adjust luminance of the media content based upon the one or more estimates of perceived luminance discomfort. The computer code being executed to cause the post-processing system to adjust the luminance of the media content comprises computer code that when executed, causes the post-processing system to apply a mathematical optimization function adapted to maintain a mean luminance of the media content below a luminance threshold.

In some embodiments, the computer code being executed to cause the post-processing system to adjust the luminance of the media content comprises computer code that when executed, causes the post-processing system to apply a mathematical function adapted to increase luminance in one or more frames of the media content to coincide with a visual thematic element of the media content.

In some embodiments, the memory further comprises computer code being executed to cause the one or more processors to combine the one or more estimates of perceived luminance discomfort into a frame-wide estimate of perceived luminance discomfort.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

As alluded to above, there can be trade-offs associated with improvements in the dynamic range with which content can be displayed. For example, as display dynamic ranges increase and displays become capable of producing lower blacks levels and stronger highlights, overall perceived image quality can improve. However, during abrupt transitions from a series of dark video frames to much brighter frames, a viewer's visual system can undergo strain. This adverse effect can be caused by luminance jumps, i.e., sudden or abrupt changes in illumination to which the viewer's visual system needs to adapt. Because luminance jumps are dependent on dynamic range, luminance jumps may not be readily noticed on SDR displays. However, luminance jumps become evident in HDR TVs and other displays capable of displaying an extended dynamic range. Luminance jumps are even more problematic when displays are used in close proximity to viewers' eyes, such as mobile phone displays implemented as head mounted displays (HMDs). Accordingly, understanding, measuring, and/or counteracting the relationship between dynamic range and discomfort that can result from the presentation of content on HDR devices is becoming more and more important.

Various embodiments disclosed herein provide systems and methods for assessing the level of discomfort when a sequence of images or frames is experienced on a certain display under specific viewing conditions, as well as providing mechanisms for post-processing those image sequences to ensure they remain within a desired luminance comfort zone (or zone of discomfort).

Figure 1:
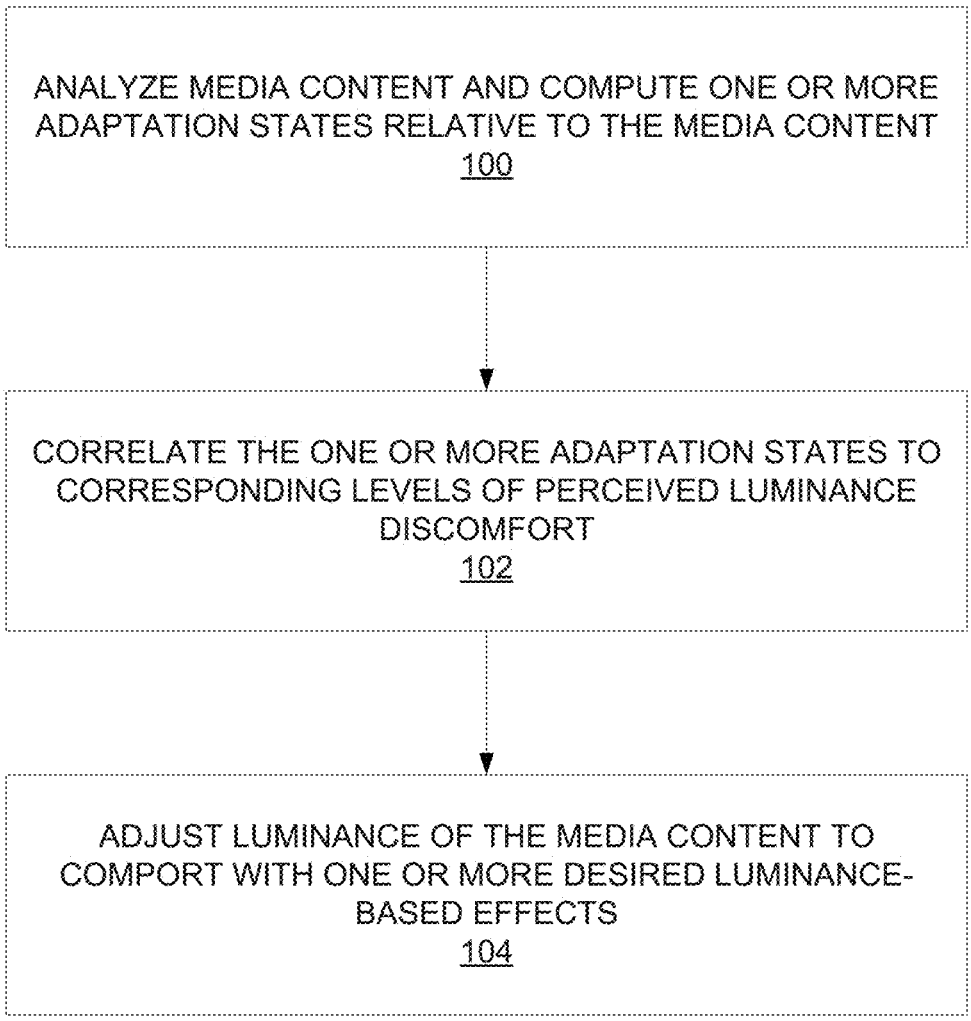
FIG. 1 is a flow chart illustrating example operations that can be performed to predict luminance discomfort and adjust luminance of content in accordance with various embodiments.

FIG. 1 illustrates example operations performed in accordance with various embodiments for predicting luminance discomfort and adjusting the luminance of media content. FIG. 1 will be described in conjunction with FIG. 2, a video processing pipeline in which the luminance discomfort prediction and luminance adjustment may be implemented.

At operation 100, media content may be analyzed, and one or more adaptation states relative to the media content can be calculated. Analysis of the media content can be performed by a maladaptation analysis and computation component 202 that receives media content, for example, HDR video content. As will be described in greater detail below, analysis of the media content can be performed on a frame-by-frame basis. The computation of adaptation states can involve determining when media content may result in a discrepancy between the adaptation level of the viewer's visual system and a luminance level being experienced by the viewer's visual system (referred to as maladaptation).

Figure 3A:
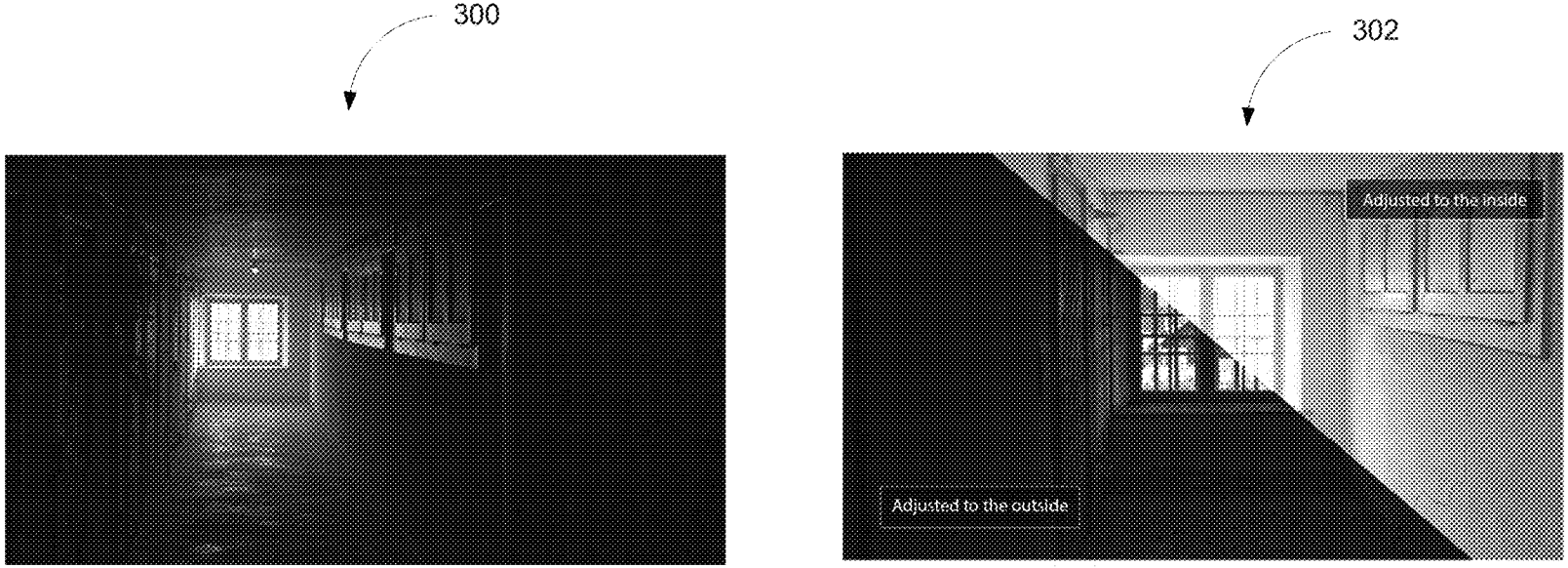
FIG. 3A is an example of a light adaptation graph.

In particular, visual systems can rely on adaptation to optimize sensitivity with respect to prevailing levels of stimulation. As the amount of light reaching a retina changes, the human visual system constantly tries to adapt to the new viewing conditions. While luminance adaptation is fast, it is not instant. Thus, visual acuity can be temporarily lost when, as previously described, the human visual system must quickly adapt to bright conditions. FIG. 3A illustrates such a scenario. For example, a viewer may experience an image or video representative of a dark hallway (image 300) such that the viewer's visual system is adapted to a low light situation. Image 302 illustrates the effect of adaptation to low light (inside the hallway) and adaptation to bright light (daylight). As can be appreciated, when the visual system is adapted or adjusted to low light, the visual system would experience a loss in acuity as evidenced by, e.g., the lack of contrast and detail seen through the window. That is, the view through the window when the visual system is adjusted to the inside, low light conditions, is primarily just bright light. This is in contrast to the view through the window when the visual system has adjusted to the brighter, outside lighting conditions, resulting in better visual acuity. During such a transition, the human visual system can experience maladaptation before it has adapted to the brighter conditions.

Adaptation can be quantified with threshold versus intensity (TVI) functions, which give a threshold, $\Delta L$, required to create a visible contrast at various (background) luminance levels, L. Classically, TVI functions are measured using spot-on-background patterns. An observer's visual system is adapted to a circular background field of a particular luminance (L), and then tested to see how much more intense ($\Delta L$) a central spot must be in order to be visible. By repeating this experiment for a range of background luminances, the TVI functions can be described. That is, a test stimulus can be presented on a background of a certain luminance, where the stimulus is increased until the stimulus can be detected against the background.

Figure 3B:
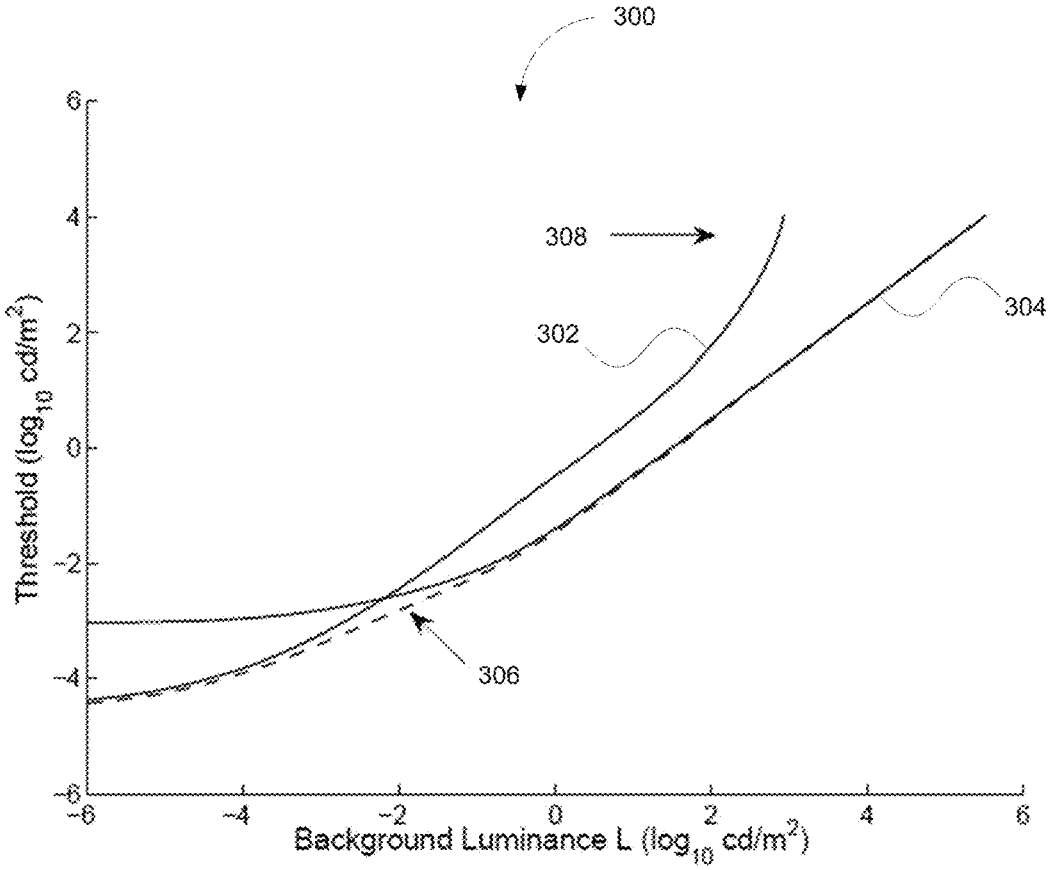
FIG. 3B illustrates example frames of video content representing a transition in luminance.

FIG. 3B is an example light adaptation graph 300 (representative of conditions that shift from dark to light). Curves 302 and 304 can indicate TVI functions for the rod and cone systems of the human visual system, respectively, where the y-axis represents the aforementioned threshold in $\log_{10}$ candelas/meter squared, and the x-axis represents luminance, in this example, background luminance in $\log_{10}$ candelas/meter squared. It should be noted that light adaptation graph 300 is presented logarithmically simply to condense scale for ease of representation.

Curves 302 and 304 are relatively flat at extremely low luminance levels and become linear over the range where the visual system adapts well (approximately at 306). As background luminance increases, visual function shifts from the rod system to the cone system. Rod curve 302 bends upward when luminance is high due to saturation at 308. At saturation, the rod system is no longer able to detect the stimulus. This is because the rod system has a limited ability to adapt to brighter conditions.

Steady-state local luminance adaptation and the time course of luminance adaptation have been studied, and computational models have been independently proposed for both adaptation contexts. One example of a steady-state local luminance adaptation model is described in "A Model of Local Adaptation," Vangorp, Peter et al., *ACM Trans. Graph.,* 34 (6):166:1-166:13, 2015. One example of a temporal luminance adaptation model is described in "Perceptually Based Tone Mapping of High Dynamic Range Image Streams," Irwan, Piti et al., *Proceedings of the Sixteenth*

*Eurographics Conference on Rendering Techniques*, EGSR '05, pgs. 231-242, 2005. Both references are incorporated herein by reference in their entirety.

A function, Ø, can be defined for computing the level of local adaptation, $\hat{L}$, (expressed in cd/m$^2$) as follows:

$$Ø: L_x, L_K, L_x^{amb} \rightarrow \hat{L}_x,$$

where $L_x$ can refer to the display luminance in cd/m$^2$ at some pixel x, and K can denote a local spatial neighborhood around pixel x. If the condition $L_x \neq \hat{L}_x$ is satisfied, the viewer is spatially maladapted at pixel x.

The function Ø assumes steady-state adaptation, i.e., none of its parameters are time dependent. That is, the function Ø can describe an idealized case where the viewer keeps his/her gaze on a static image long enough to become fully adapted to it, and the ambient illumination remains the same. In practice, while ambient luminance, $L^{amb}$, might remain constant within certain limits, the display content often changes dynamically, thereby triggering the adaptation mechanisms of the human visual system accordingly. It should be noted that ambient luminance can refer to lighting other than that emanating from a display or screen on which content is presented. This can include, for example, ceiling lights, lamps, or other light sources in a room where a display is located.

On the other hand, the time-dependent interplay between display luminance and adaptation can be expressed as a new function Φ:

$$\Phi^t: L_x^t, L_K^t, L_x^{amb}, \hat{L}_x^{t-1} \rightarrow \hat{L}_x^t,$$

where the superscript t denotes time, and $\hat{L}_x^{t-1}$ expresses the adaptation level measured at the previous time instant. Similar to the spatial case, if the condition $L_x^t \neq \hat{L}_x^t$, is satisfied, it is an indication of spatio-temporal maladaptation. It should be noted that the aforementioned functions are examples, and not meant to limiting in any way. Other models or combinations of models may be utilized to determine adaptation states in content.

Given certain content or one or more portions of content, spatio-temporal maladaptation can be predicted using the above function. Implementation of the above function can be accomplished through, e.g., a convolution of filters that may be applied to the content in the image and/or frequency domains. For example, if content comprises an illumination level at a particular pixel of 100 cd/m$^2$ at time t=2, and the illumination level at that pixel is 20 cd/m$^2$ at time t=1, it can be assumed that a viewer will be maladapted when viewing that pixel during the transition between time t=1 to t=2. Thus, a viewer's local (spatial) and time-dependent maladaptation (taking into account, ambient illumination, previous adaptation state at the same location, and display luminance within a spatial neighborhood) can be determined. It should be noted that luminance discomfort can be predicted for every frame or other sequence of images that may be considered appropriate for addressing luminance discomfort.

It should be further noted that although the previously described functions can predict maladaptation on a relatively small scale, i.e., on a per-pixel basis, predicting adaptation states over all pixels in a frame may be resource-intensive and/or time-consuming. Moreover, the luminance of a single pixel may not be representative of an entire frame. Hence, adaptation states may be predicted using some aggregate or average luminance associated with multiple pixels or portions of frames.

Accordingly, some embodiments of the present disclosure may implement a "pooling function" to avoid analyzing content in a manner that is overly granular. For example, a frame of video content may contain a subset of pixels representative of a relatively small spotlight that does not impact a viewer's perception of the overall luminance of that frame. A pooling function can be utilized to adapt the maladaptation model for use with some larger subset of pixels to get a more accurate representation of luminance in the frame.

As alluded to above, various embodiments provide a metric that estimates the perceived magnitude of spatio-temporal maladaptation by utilizing subjective data indicative of luminance discomfort along with the measured display luminance, $L_x^t$, and the predicted adaptation state of the human visual system, $\hat{L}_x^t$. That is, while the above spatio-temporal maladaptation model can predict when and where maladaptation occurs in content, as well as the level of maladaptation, how a viewer is impacted in terms of discomfort is still unknown.

Hence, at operation 102, the one or more adaptation states can be correlated with or mapped to one or more corresponding levels of perceived luminance discomfort. As will be described below, perceived luminance discomfort may be characterized through certain real-world testing of viewers' perceived discomfort during one or more presentations of content or other stimuli whose luminance characteristics can be varied. The data obtained from such testing can be used to generate a luminance discomfort model. Data indicative of this luminance discomfort model can be stored within luminance discomfort database 204. Luminance discomfort mapping and computation component 206 may perform the correlation between adaptation states in the media content (received from maladaptation analysis and computation component 202) and perceived levels of luminance discomfort (stored in luminance discomfort database 204). In this way, media content resulting in a potential state of maladaptation can be quantified in the context of perceived discomfort, i.e., the maladaptation model can be used to calculate or determine adaptation states and from that, perceived discomfort can be derived.

During testing, mean, ambient, and/or displayed luminance can be adjusted. Conditions reflecting these varying parameters may be presented to viewers to determine what combinations/levels of variation lead to luminous discomfort, as well as how much or at what level, luminous discomfort is experienced.

In particular, subjective experiments can be conducted where an HDR display may be utilized to show short video clips, for example, two second clips. A first portion of the video clip can comprise frames having low mean luminance, $L^L$, and a second portion of the video clip can comprise frames having a higher mean luminance, $L^H$. This may simulate the abrupt transition from dark to light resulting in maladaptation. Ambient illumination level, $L^{amb}$, can be another luminance factor to consider.

To understand the relationship between content type and luminance discomfort, content type can be varied between solid gray frames (no content), random textures created using, e.g., Perlin noise (abstract content), and live action frames (natural content). Participants of such experiments can be asked to rate their level of discomfort. For example, participants can rank discomfort on a 5-point scale, where a 5 designates content to be un-watchable due to perceived discomfort, a 1 designates content that is not associated with any discomfort, and a 3 designates content that is barely tolerable due to perceived discomfort. In a scenario where a test subject is put into a room that has 20 cd/m$^2$ of ambient illumination, and content is presented wherein a video frame transitions or jumps from 1 cd/m$^2$ of illumination to 100 cd/m$^2$, the test subject may indicate a luminance discomfort rating of 3. It should be noted that other scales and/or methods of ranking perceived discomfort may be used.

By obtaining sufficient subjective responses across various ranges of luminance parameters, subjective data for calibrating the luminance discomfort metric can be obtained. In other words, data points reflecting test subjects' perceived luminance discomfort relative to known luminance jumps and/or luminance parameter variations, e.g., ambient luminance, can be stored, analyzed, and/or extrapolated to generate a statistically meaningful luminance discomfort model.

Noting that display luminance, $L_x^t$, and a predicated adaptation state, $\hat{L}_x^t$, denote luminance values in physical units, a transducer function, $\tau$, may be used to obtain the perceived discomfort caused by spatio-temporal maladaptation.

$$\tau: L^t, L^{t-1}, L^{amb}, \hat{L}^t \rightarrow \overline{D}^t,$$

$D^t$ can refer the subjective test data, i.e., perceived luminance discomfort rankings. Transducer function $\tau$ can predict the perceived luminance discomfort, $\overline{D}$, on the 5-point scale discussed above given the following: display luminance at time instances t and t−1; ambient luminance $L^{amb}$; and a current adaptation level, $\hat{L}^t$. It should be understood that as the discrepancy between $L^t$ and $L^{t-1}$ increases, luminance discomfort can be assumed to be greater.

It should be understood that the above transducer function incorporates a mapping function from $\hat{L}^t$ to $\hat{D}^t$ that minimizes $\|D^t-\overline{D}^t\|^2$ over all the obtained subjective data to achieve data that is normalized/improve data integrity. That is, transducer function $\tau$ is designed to minimize the difference of test data $D^t$ to predicted luminance discomfort $\overline{D}^t$. Additionally, for practical reasons, as noted above, transfer function $\tau$ can be defined per-frame (or some other subset) rather than per-pixel. Thus, the aforementioned pooling function may combine per-pixel luminance discomfort estimates or predictions into frame-wide luminance discomfort estimates or predictions.

At operation 104, the luminance of the media content (HDR video content in this example) may be adjusted to comport with one or more desired luminance-based effects. For example, post-processing system 208 may be utilized by a content producer to adjust the mean luminance of one or more frames in the media content that are predicted to produce luminance discomfort in viewers' visual systems. On the other hand, a content producer may want viewers to experience some level of luminance discomfort to enhance the viewing experience, in which case, post-processing system 208 can be utilized to raise the level of luminance discomfort of one or more frames in the media content.

In some embodiments, the estimate of perceived luminance discomfort can be utilized alone for analysis purposes. However, some embodiments may further rely on the perceived luminance discomfort to adjust the mean luminance, $\overline{L}^t$, of each video frame in post-processing with the overall goal of reducing visual discomfort. A generic objective can be expressed as:

$$\operatorname{argmin}_{\overline{L}^t} \int \overline{D}^t dt.$$

The displayed mean luminance $\overline{L}^t$ can be adjusted such that the overall perceived discomfort over time is minimized. This can be accomplished in post processing process by retaining the content's original mean luminance as much as possible (e.g., minimize $\|L-\overline{L}\|^2$) to maintain image quality, prevent clipping, attempt to evenly distribute the discomfort energy (area under the $\hat{D}^t$ plot over time), etc. For example, a director may utilize post-processing system 208 to apply a mathematical optimization function to adjust the mean luminance of an entire movie to ensure that a perceived luminance discomfort level of 3 is never exceeded.

As with the aforementioned functions, the above-noted equation is merely a generic equation for minimizing some energy function to remain as close as possible to an adaptation luminance to avoid discomfort. However, other and/or more explicit functions may be used. For example, a director may utilize post-processing system 208 to apply a mathematical function to re-adjust the luminance of one or more frames to exceed a mean perceived luminance discomfort level. That is, the director may desire luminance discomfort to exceed level 3 during a scene with an explosion.

Figure 2:
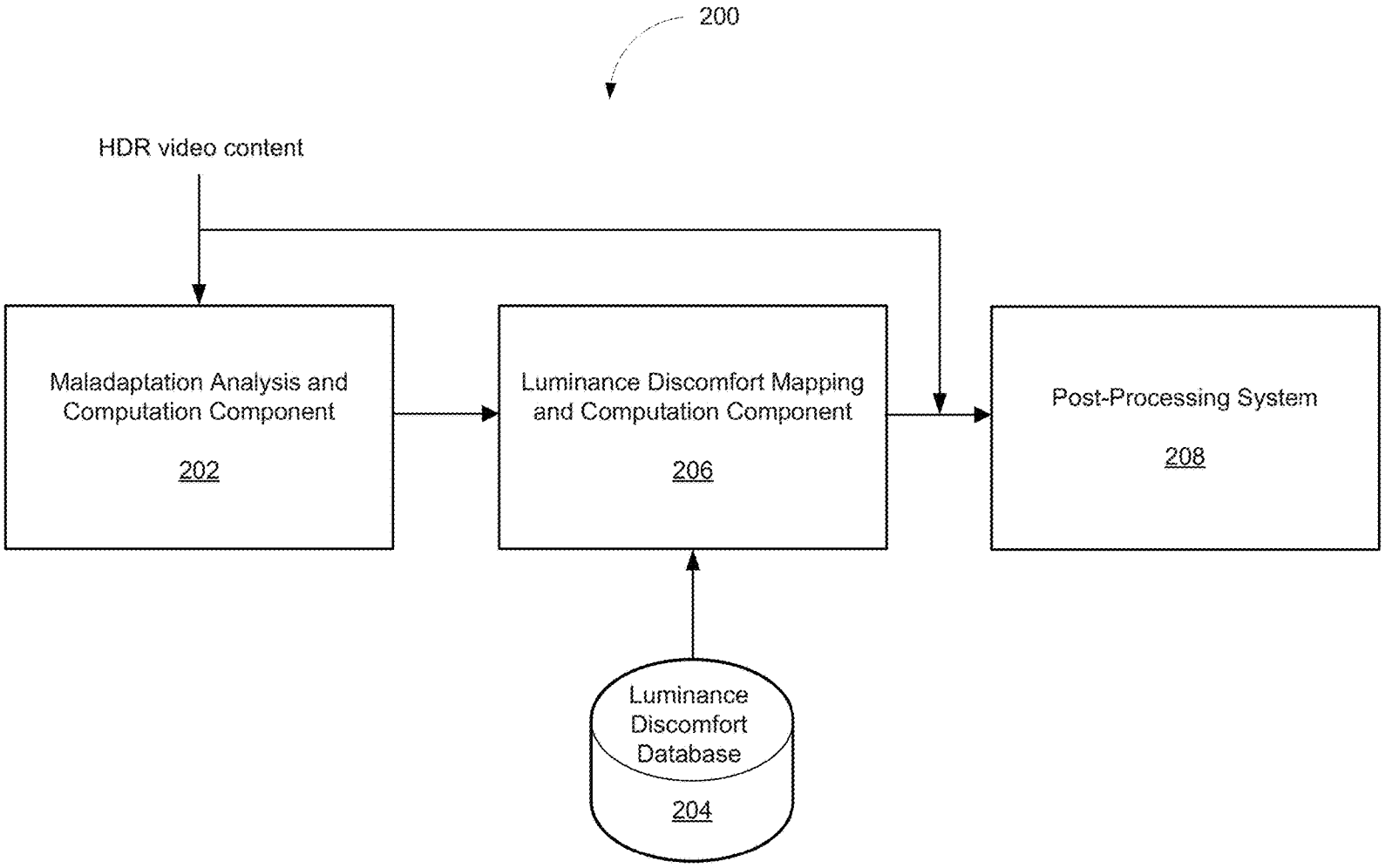
FIG. 2 is a schematic representation of a video processing pipeline in which the luminance discomfort prediction and luminance adjustment of FIG. 1 may be implemented in accordance with various embodiments.
Figure 4:
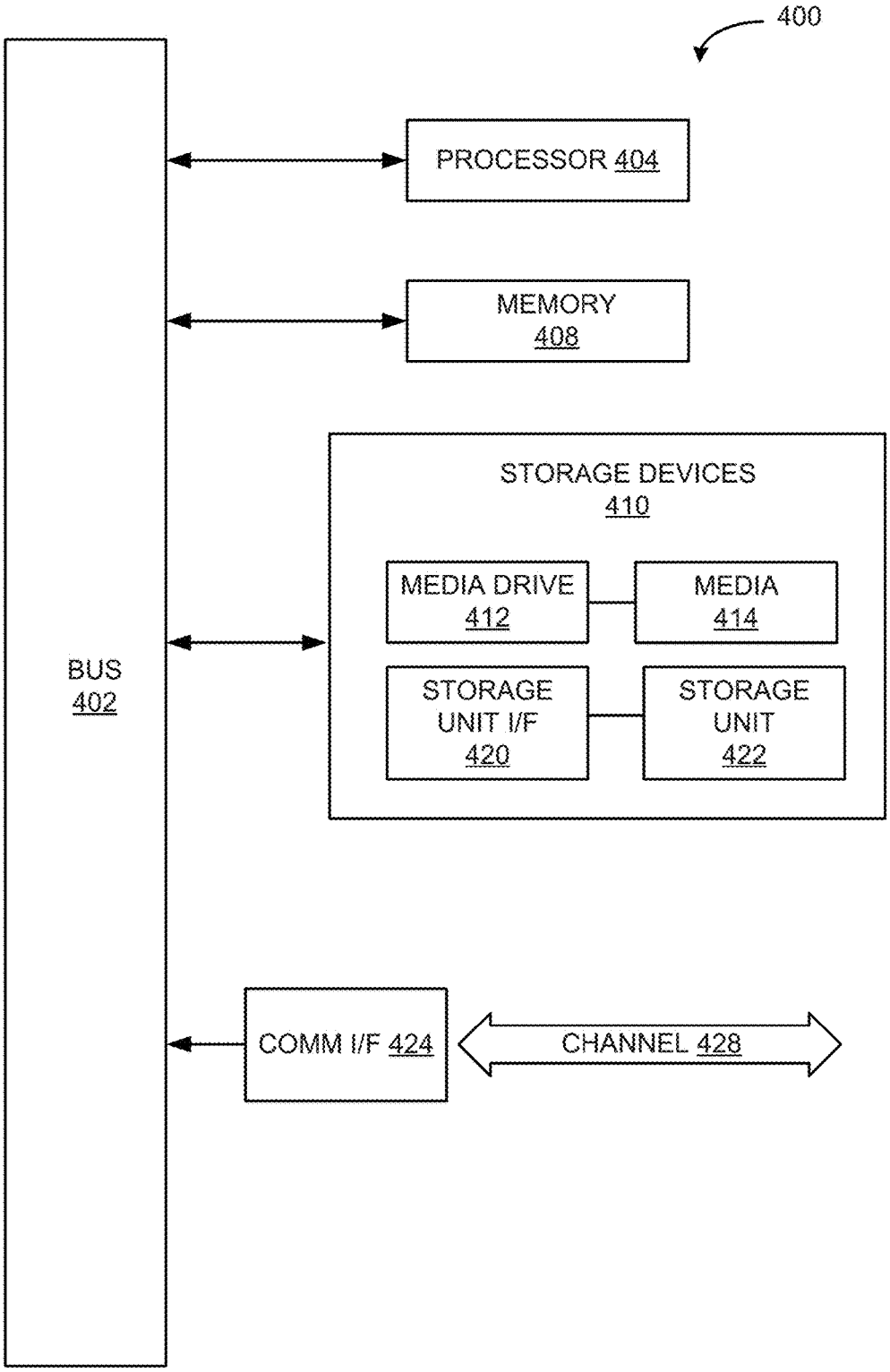
FIG. 4 is an example computing component that may be used to implement various features of embodiments described in the present disclosure.

FIG. 4 illustrates an example computing component that may be used to implement various features of the system and methods disclosed herein, such as the aforementioned features and functionality of one or more aspects of components 202, 204, 206, and/or 208 of FIG. 2.

As used herein, the term component might describe a given unit of functionality that can be performed in accordance with one or more embodiments of the present application. As used herein, a component might be implemented utilizing any form of hardware, software, or a combination thereof. For example, one or more processors, controllers, ASICs, PLAs, PALs, CPLDs, FPGAs, logical components, software routines or other mechanisms might be implemented to make up a component. In implementation, the various components described herein might be implemented as discrete components or the functions and features described can be shared in part or in total among one or more components. In other words, as would be apparent to one of ordinary skill in the art after reading this description, the various features and functionality described herein may be implemented in any given application and can be implemented in one or more separate or shared components in various combinations and permutations. Even though various features or elements of functionality may be individually described or claimed as separate components, one of ordinary skill in the art will understand that these features and functionality can be shared among one or more common software and hardware elements, and such description shall not require or imply that separate hardware or software components are used to implement such features or functionality.

Where components or components of the application are implemented in whole or in part using software, in one embodiment, these software elements can be implemented to operate with a computing or processing component capable of carrying out the functionality described with respect thereto. One such example computing component is shown in FIG. 4. Various embodiments are described in terms of this example-computing component 400. After reading this description, it will become apparent to a person skilled in the relevant art how to implement the application using other computing components or architectures.

Referring now to FIG. 4, computing component 400 may represent, for example, computing or processing capabilities found within a self-adjusting display, desktop, laptop, notebook, and tablet computers; hand-held computing devices (tablets, PDA's, smart phones, cell phones, palmtops, etc.); workstations or other devices with displays; servers; or any other type of special-purpose or general-purpose computing devices as may be desirable or appropriate for a given application or environment. Computing component 400 might also represent computing capabilities embedded within or otherwise available to a given device. For example, a computing component might be found in other electronic devices such as, for example navigation systems, portable computing devices, and other electronic devices that might include some form of processing capability.

Computing component 400 might include, for example, one or more processors, controllers, control components, or other processing devices, such as a processor 404. Processor 404 might be implemented using a general-purpose or special-purpose processing engine such as, for example, a microprocessor, controller, or other control logic. In the illustrated example, processor 404 is connected to a bus 402, although any communication medium can be used to facilitate interaction with other components of computing component 400 or to communicate externally.

Computing component 400 might also include one or more memory components, simply referred to herein as main memory 408. For example, preferably random access memory (RAM) or other dynamic memory, might be used for storing information and instructions to be executed by processor 404. Main memory 408 might also be used for storing temporary variables or other intermediate information during execution of instructions to be executed by processor 404. Computing component 400 might likewise include a read only memory ("ROM") or other static storage device coupled to bus 402 for storing static information and instructions for processor 404.

The computing component 400 might also include one or more various forms of information storage mechanism 410, which might include, for example, a media drive 412 and a storage unit interface 420. The media drive 412 might include a drive or other mechanism to support fixed or removable storage media 414. For example, a hard disk drive, a solid state drive, a magnetic tape drive, an optical disk drive, a compact disc (CD) or digital video disc (DVD) drive (R or RW), or other removable or fixed media drive might be provided. Accordingly, storage media 414 might include, for example, a hard disk, an integrated circuit assembly, magnetic tape, cartridge, optical disk, a CD or DVD, or other fixed or removable medium that is read by, written to or accessed by media drive 412. As these examples illustrate, the storage media 414 can include a computer usable storage medium having stored therein computer software or data.

In alternative embodiments, information storage mechanism 410 might include other similar instrumentalities for allowing computer programs or other instructions or data to be loaded into computing component 400. Such instrumentalities might include, for example, a fixed or removable storage unit 422 and an interface 420. Examples of such storage units 422 and interfaces 420 can include a program cartridge and cartridge interface, a removable memory (for example, a flash memory or other removable memory component) and memory slot, a PCMCIA slot and card, and other fixed or removable storage units 422 and interfaces 420 that allow software and data to be transferred from the storage unit 422 to computing component 400.

Computing component 400 might also include a communications interface 424. Communications interface 424 might be used to allow software and data to be transferred between computing component 400 and external devices. Examples of communications interface 424 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 424 might typically be carried on signals, which can be electronic, electromagnetic (which includes optical) or other signals capable of being exchanged by a given communications interface 424. These signals might be provided to communications interface 424 via a channel 428. This channel 428 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to transitory or non-transitory media such as, for example, memory 408, storage unit 420, media 414, and channel 428. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing component 400 to perform features or functions of the present application as discussed herein.

Although described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the application, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A computer-implemented method, comprising:

analyzing media content and computing one or more adaptation states relative to the media content by estimating a perceived magnitude of maladaptation;

quantifying the perceived magnitude of maladaptation in terms of perceived luminance discomfort by correlating the one or more adaptation states to one or more corresponding levels of perceived luminance discomfort experienced by one or more viewers of test media content, the test media content comprising known variations in luminance; and adjusting luminance of the media content to comport with one or more desired luminance-based effects relative to the perceived luminance discomfort.

2. The computer-implemented method of claim 1, wherein the analyzing of the media content comprises determining a luminance level associated with a pixel of a frame of the media content.

3. The computer-implemented method of claim 2, wherein the analyzing of the media content comprises determining a luminance level associated with a spatial neighborhood approximately about the pixel.

4. The computer-implemented method of claim 3, wherein the analyzing of the media content comprises determining an ambient luminance level relative to the pixel.

5. The computer-implemented method of claim 2, wherein the computing of the one or more adaptation states comprises determining a level of local adaptation predicted as being experienced by the viewer relative to the pixel.

6. The computer-implemented method of claim 5, wherein the level of local adaptation is determined relative to a period between at least two times during which the luminance level associated with the pixel is determined.

7. The computer-implemented method of claim 1, further comprising applying a pooling function to combine the one or more corresponding levels of perceived luminance discomfort associated with determined luminance levels of one or more pixels of a frame of the media content, the combination of the one or more corresponding levels of perceived luminance discomfort comprising a frame-wide estimate of perceived luminance discomfort.

8. The computer-implemented method of claim 1, wherein each of the one or more corresponding levels of perceived luminance discomfort determination of discomfort experienced during exposure to test media content having commensurate luminance characteristics as the analyzed media content.

9. The computer-implemented method of claim 1, further comprising applying a transducer function to translate characterization of the one or more adaptation states to characterizations of perceived luminance discomfort.

10. The computer-implemented method of claim 1, wherein the adjusting of the luminance of the media content to comport with one or more desired luminance-based effects comprises applying a mathematical optimization function adapted to maintain a mean luminance of the media content below a luminance threshold.

11. The computer-implemented method of claim 1, wherein the adjusting of the luminance of the media content to comport with one or more desired luminance-based effect comprises applying a mathematical function adapted to increase luminance in one or more frames of the media content to coincide with a visual thematic element of the media content.

12. A system, comprising:

one or more processors; and a memory having computer code being executed to cause the one or more processors to:

analyze one or more pixels of a frame of media content;

compute one or more adaptation states by estimating a perceived magnitude of maladaptation relative to each of the one or more pixels;

quantify the perceived magnitude of maladaptation in terms of perceived luminance discomfort by translating the one or more adaptation states to one or more estimates of perceived luminance discomfort experienced by one or more viewers of test media content, the test media content comprising known variations in luminance, when the one or more adaptation states is indicative of maladaptation of a visual system viewing the media content; and adjust luminance of the media content to comport with one or more desired luminance-based effects relative to the perceived luminance discomfort.

13. The system of claim 12, wherein the computer code being executed further causes the one or more processors to determine a luminance level associated with a spatial neighborhood approximately about each of the one or more pixels.

14. The system of claim 13, wherein the computer code being executed further causes the one or more processors to determine an ambient luminance level relative to each of the one or more pixels.

15. The system of claim 12, wherein the one or more computed adaptation states are indicative of maladaptation on spatial and temporal levels.

16. The system of claim 12, wherein the computer code being executed to cause the one or more processors to translate the one or more adaptation states comprises computer code that when executed, causes the one or more processors to convert characterizations of the one or more adaptation states from physical luminance units to subjective rankings of the perceived luminance discomfort.

17. The system of claim 12, further comprising a post-processing system having computer code being executed to cause the post-processing system to adjust luminance of the media content based upon the one or more estimates of perceived luminance discomfort.

18. The system of claim 17, wherein the computer code being executed to cause the post-processing system to adjust the luminance of the media content comprises computer code that when executed, causes the post-processing system to apply a mathematical optimization function adapted to maintain a mean luminance of the media content below a luminance threshold.

19. The system of claim 17, wherein the computer code being executed to cause the post-processing system to adjust the luminance of the media content comprises computer code that when executed, causes the post-processing system to apply a mathematical function adapted to increase luminance in one or more frames of the media content to coincide with a visual thematic element of the media content.

20. The system of claim 12, wherein the memory further comprises computer code being executed to cause the one or more processors to combine the one or more estimates of perceived luminance discomfort into a frame-wide estimate of perceived luminance discomfort.

* * * * *